US008807462B2

(12) United States Patent
Tix et al.

(10) Patent No.: US 8,807,462 B2
(45) Date of Patent: Aug. 19, 2014

(54) VARIABLE FLUID FLOW IN AIR-OPERATED TWO COMPONENT GUN APPLICATOR

(75) Inventors: Joseph E. Tix, Hastings, MN (US); Christopher J. Pellin, Burnsville, MN (US); Mark T. Weinberger, Mounds View, MN (US); Jeffrey N. Velgersdyk, Minneapolis, MN (US); Douglas S. Ryder, St. Michael, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 295 days.

(21) Appl. No.: 12/676,942

(22) PCT Filed: Sep. 11, 2008

(86) PCT No.: PCT/US2008/075959

§ 371 (c)(1),
(2), (4) Date: Mar. 8, 2010

(87) PCT Pub. No.: WO2009/036126

PCT Pub. Date: Mar. 19, 2009

(65) Prior Publication Data

US 2011/0049267 A1 Mar. 3, 2011

Related U.S. Application Data

(60) Provisional application No. 60/971,300, filed on Sep. 11, 2007.

(51) Int. Cl.
*B05B 1/30* (2006.01)
*B05B 9/01* (2006.01)

(52) U.S. Cl.
CPC ..... *B05B 9/01* (2013.01); *B05B 1/3026* (2013.01)
USPC ..... 239/582.1; 239/113; 239/408; 239/413; 239/526; 239/581.2

(58) Field of Classification Search
CPC .. B05B 12/092; B05B 1/3033; B05B 1/3026; B05B 9/01
USPC ..... 239/408, 414, 105, 110, 112, 113, 407, 239/413, 541, 579–582.1, 583, 526
See application file for complete search history.

(56) References Cited

U.S. PATENT DOCUMENTS 3,263,928 A * 8/1966 Gusmer ..... 239/123
3,924,651 A 12/1975 Hippel et al.

(Continued)

OTHER PUBLICATIONS

Graco Inc. "Fast-Set Plural-Component Equipment and Accessories" brochure published Jul. 2009, see particularly pp. 11-13 and pp. 14-15, #300615E.

(Continued)

*Primary Examiner* — Christopher Kim
(74) *Attorney, Agent, or Firm* — Kinney & Lange, P.A.

(57) ABSTRACT

A two component spray gun with low/high flow rates allows the operator to spray in confined areas at lower flow without having to change the mix module. The lower flow reduces undesirable "spray back" and will also help reduce material waste. Pneumatic piston 12 travel, which determines on/off fluid flow, can be selected on the fly to either close the fluid ports 14 which stops fluid flow, partially open the fluid ports 14 which limits fluid flow, or to fully open the fluid ports 14 to allow for maximum flow. Pneumatic piston 12 travel can be limited by means of a simple multi-position mechanical stop plunger 16. The stop bar 22 can be connected to a knob 18 or other operator input and turned or adjusted to the desired position.

2 Claims, 7 Drawing Sheets

(56) References Cited

U.S. PATENT DOCUMENTS

| | | | | |
|---|---|---|---|---|
| 4,378,335 | A | 3/1983 | Boden et al. | |
| 4,427,153 | A | 1/1984 | Schaefer | |
| 4,464,056 | A | 8/1984 | Schmitz et al. | |
| 4,497,579 | A | 2/1985 | Schmitz et al. | |
| 4,876,071 | A | 10/1989 | Toda et al. | |
| 5,157,059 | A | 10/1992 | Bauer et al. | |
| 5,219,097 | A * | 6/1993 | Huber et al. | 222/145.2 |
| 5,270,014 | A | 12/1993 | Bauer et al. | |
| 5,829,679 | A | 11/1998 | Strong | |
| 6,371,439 | B1 | 4/2002 | Trevisan | |

OTHER PUBLICATIONS

Graco Inc. "D-Gun" flyer published Dec. 2005, #337530A.
Graco Inc. "GAP Pro" flyer published Dec. 2005, #337104A.
Graco Inc. "GX-7" flyer published Dec. 2005, #337529A.

* cited by examiner

VARIABLE FLUID FLOW IN AIR-OPERATED TWO COMPONENT GUN APPLICATOR

TECHNICAL FIELD

This application claims the benefit of U.S. Application Ser. No. 60/971,300, filed Sep. 11, 2007, the contents of which are hereby incorporated by reference.

BACKGROUND ART

Spray guns for applying plural component materials such as fast set foams are well known.

DISCLOSURE OF THE INVENTION

The instant invention allows the operator to spray two component materials at variable flow rates. Pneumatic piston travel, which determines on/off fluid flow, can be selected on the fly to either close the fluid ports which stops fluid flow, partially open the fluid ports which limits fluid flow, or to fully open the fluid ports to allow for maximum flow. Pneumatic piston travel can be limited by means of a simple multi-position mechanical stop. The stop can be connected to a knob or other operator input and turned or adjusted to the desired position for the corresponding closed, partial, or full flow. Furthermore, the selectable piston travel design incorporates fine-tune adjustment for the partially open position. This feature allows the operator to decide how much to limit the flow in the partially open position.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
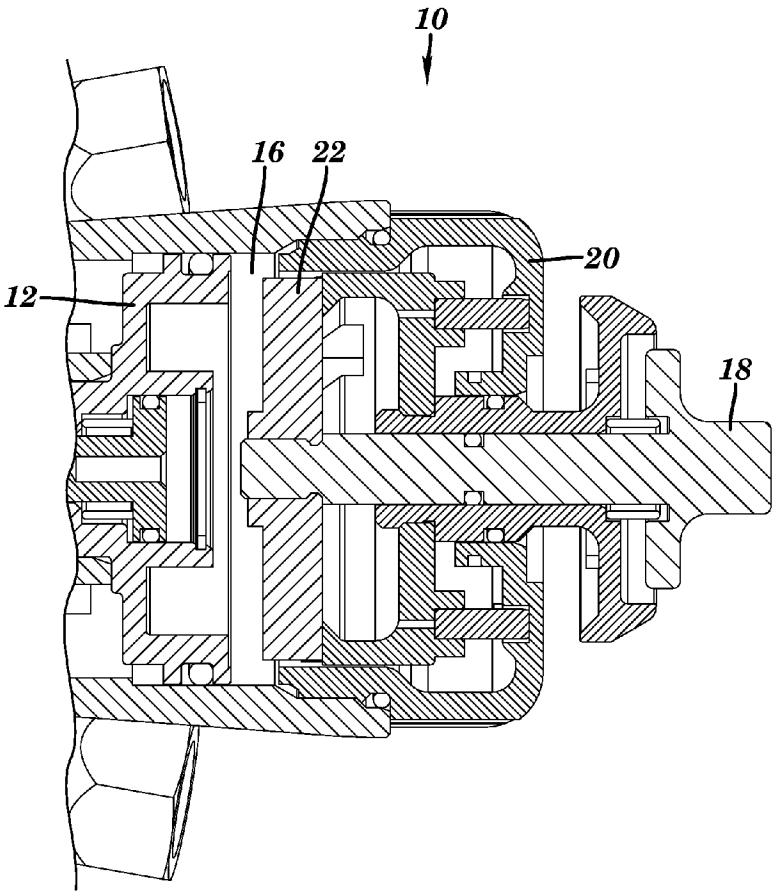
FIG. 1 shows the piston travel stop mechanism in the off position.
Figure 2:
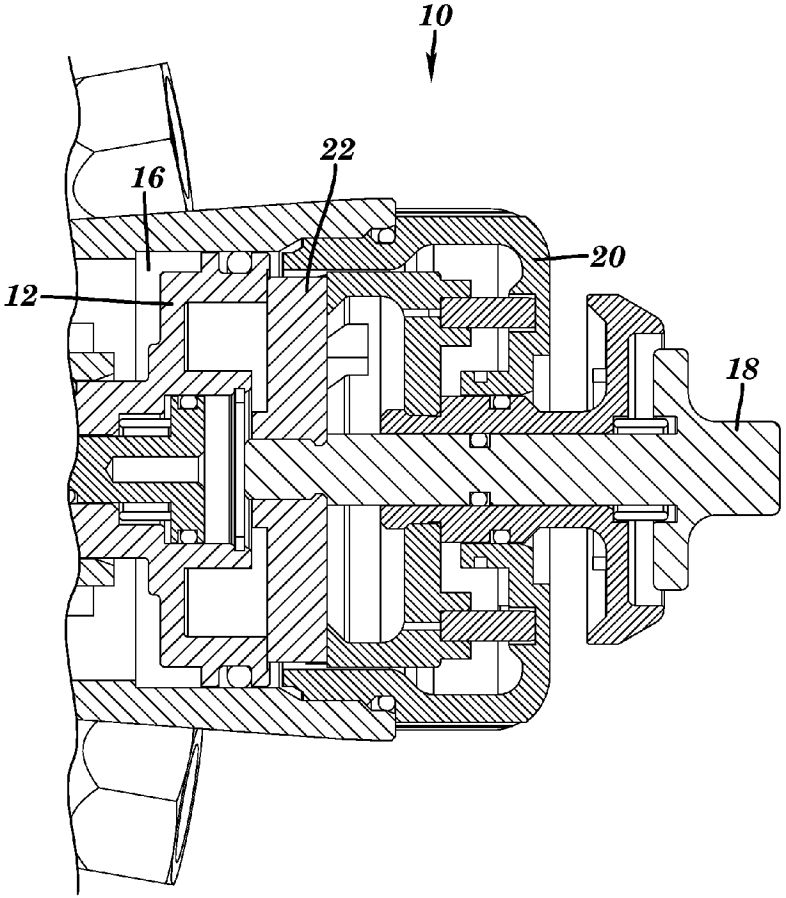
FIG. 2 shows the piston travel stop mechanism in the partially open position.
Figure 3:
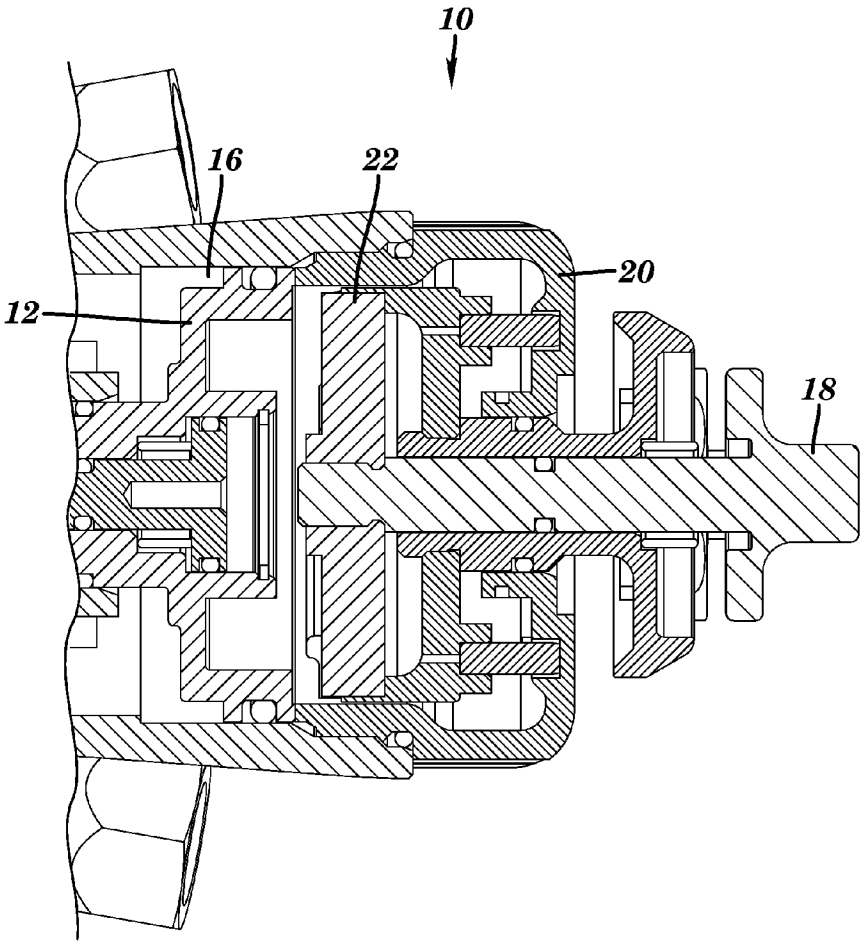
FIG. 3 shows the piston travel stop mechanism in the fully open position.
Figure 5:
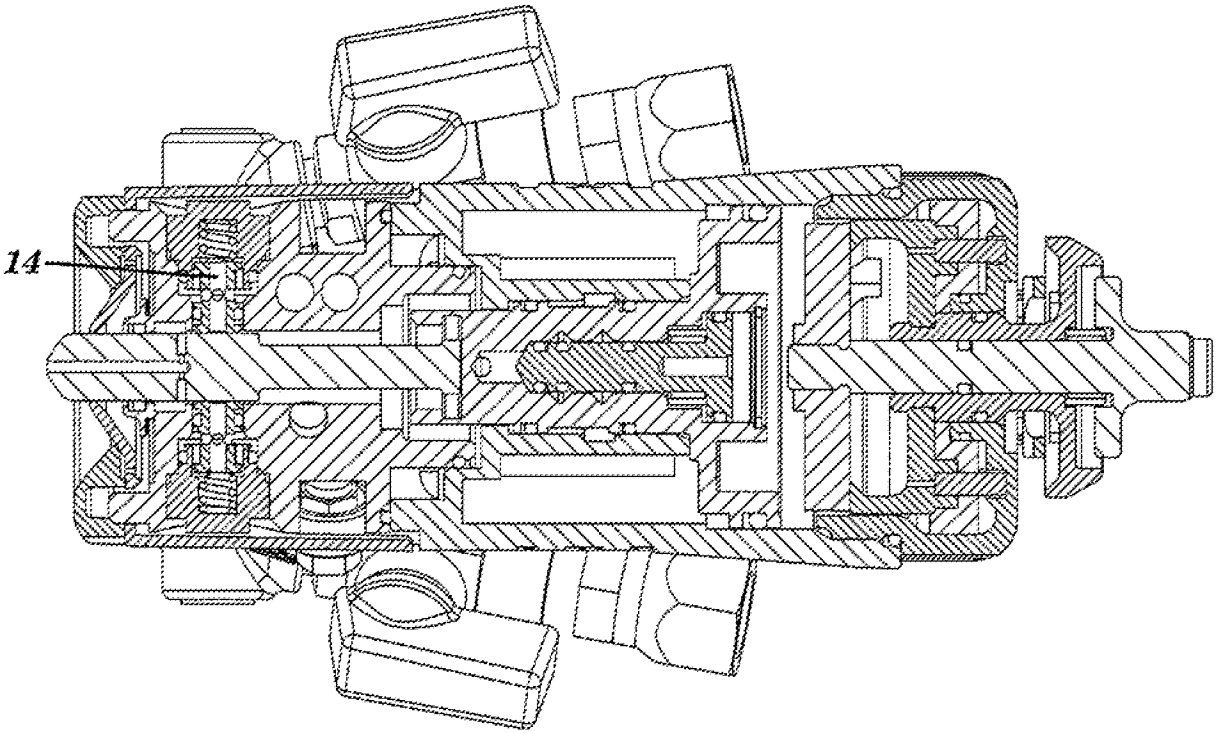
FIG. 5 shows the applicator in the off position.
Figure 6:
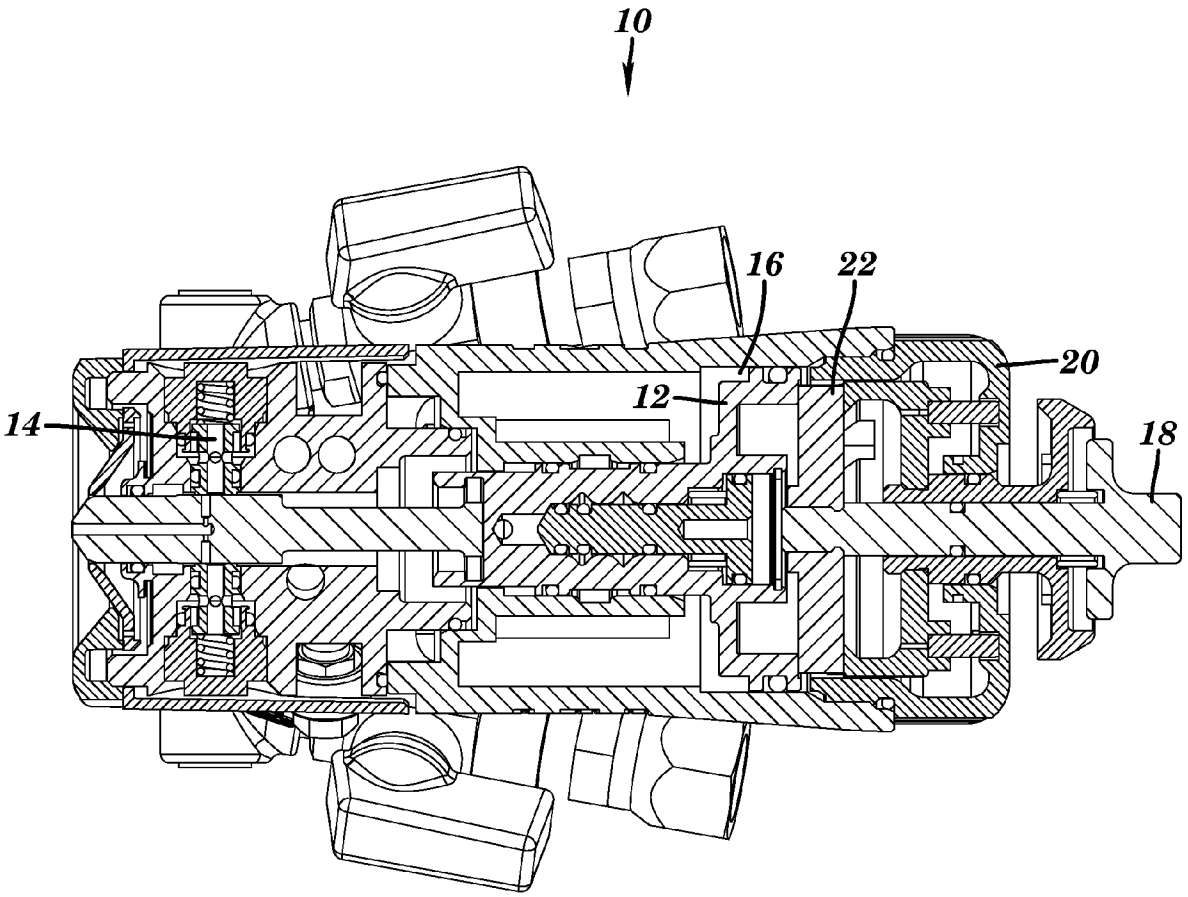
FIG. 6 shows the applicator in the partially open position.
Figure 7:
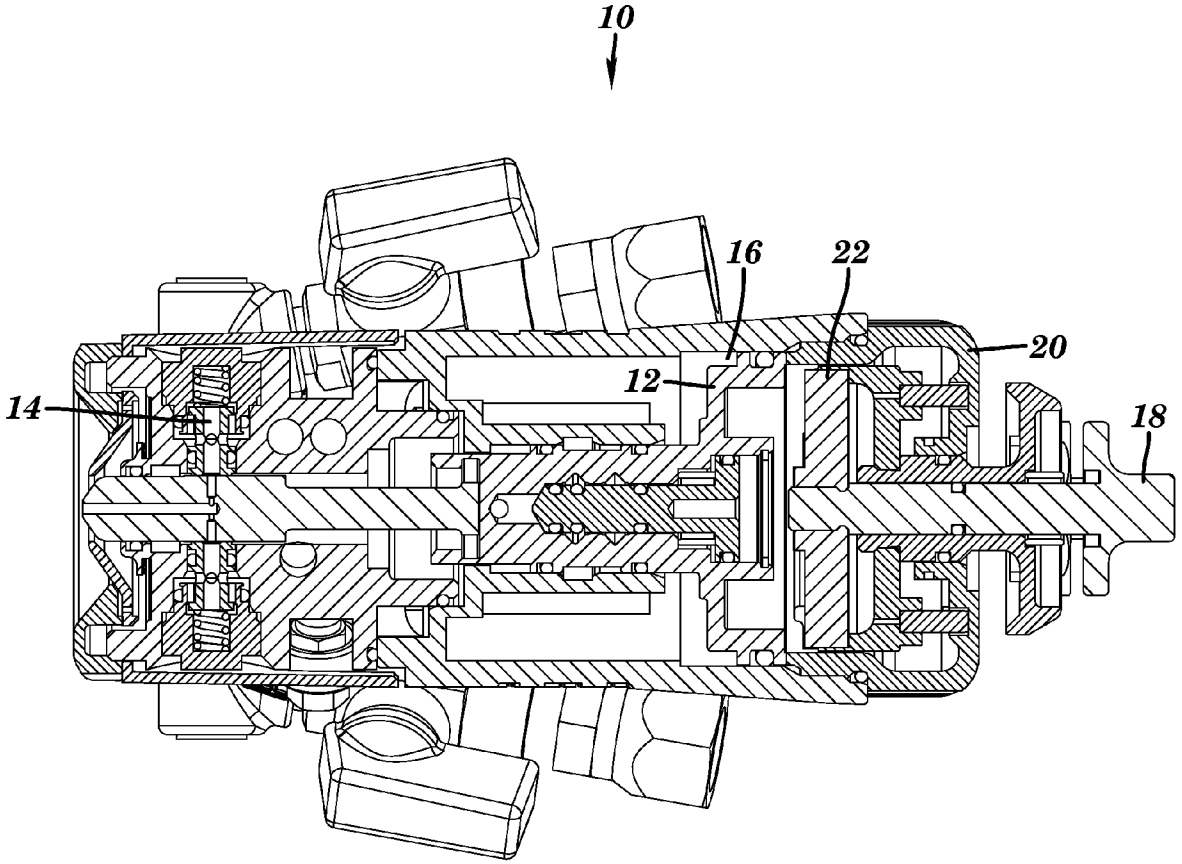
FIG. 7 shows the applicator in the fully open position.

The instant invention 10 allows the operator to spray two component materials at variable flow rates. Pneumatic piston 12 travel, which determines on/off fluid flow, can be selected on the fly to either close the fluid ports 14 (see FIGS. 1 and 5) which stops fluid flow, partially open the fluid ports 14 which limits fluid flow (see FIGS. 2 and 6), or to fully open the fluid ports 14 (see FIGS. 3 and 7) to allow for maximum flow. Pneumatic piston 12 travel can be limited by means of a simple multi-position mechanical stop plunger 16. The stop bar 22 can be connected to a knob 18 or other operator input and turned or adjusted to the desired position for the corresponding closed, partial, or full flow to position the stop bar plunger 16 accordingly.

Figure 4:
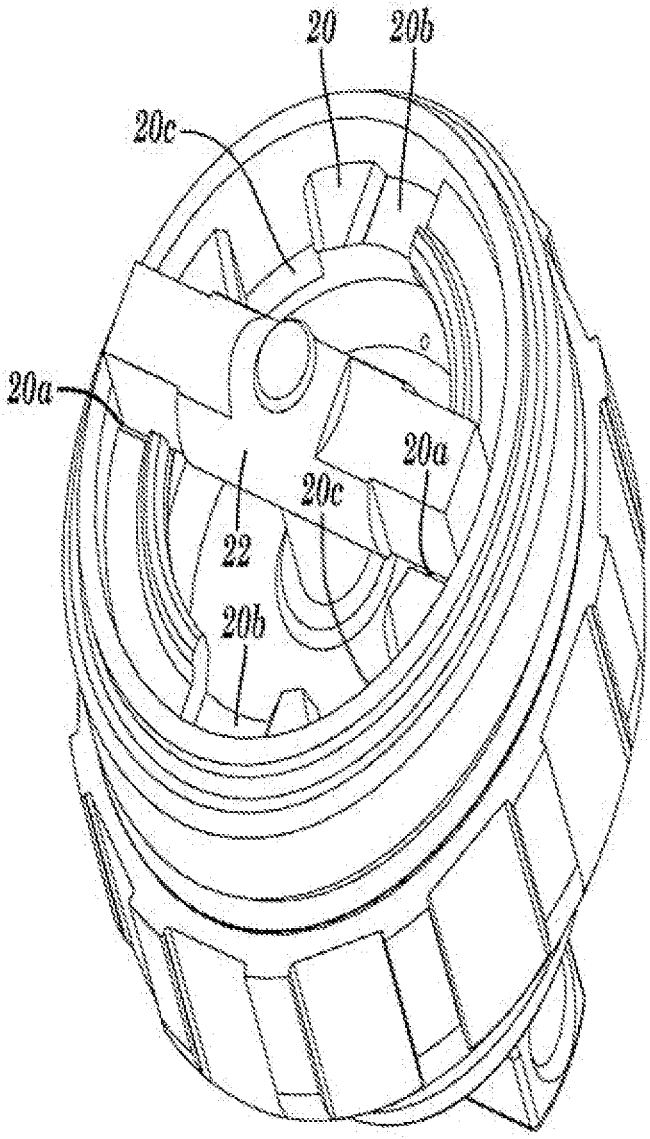
FIG. 4 shows the variable stop positions on the air cylinder cap.

Furthermore, the selectable piston travel design incorporates fine-tune adjustment for the partially open position. The air cylinder cap 20 is threadedly adjustable in and out to vary the partially open/low flow position. This feature allows the operator to decide how much to limit the flow in the partially open position. FIG. 4 shows the air cylinder cap 20 having variable depth notches 20*a*, 20*b* and 20*c* for positioning the stop bar plunger 22 in the closed, partially open and fully open positions respectively.

It is contemplated that various changes and modifications may be made to the variable flow plural component applicator without departing from the spirit and scope of the invention as defined by the following claims.

The invention claimed is:

1. A plural component air purge spray gun having fluid ports, the plural component air purge spray gun comprising:

a pneumatic piston positioned to selectively cover said fluid ports and moveable between a closed position preventing flow through said ports, a partially open position allowing a limited amount of flow through said ports and a fully open position allowing full flow through said ports;

a mechanical stop plunger selectively positionable to limit travel of said piston to one of said positions;

a stop bar configured to rest within and movable between variable depth notches to position said mechanical stop plunger according to said positions, each of said variable depth notches corresponding to one of said closed position, said partially open position, and said fully open position; and an operator positionable knob connected to said stop bar to selectively position said stop bar according to said positions.

2. The plural component spray gun of claim 1 further comprising a housing and an air cylinder cap, wherein said air cylinder cap is threadedly engaged in said housing and is positionable to adjust the flow in said partially open position.

* * * * *